United States Patent [19]

Ueki et al.

[11] Patent Number: 4,638,789

[45] Date of Patent: Jan. 27, 1987

[54] SAFETY APPARATUS FOR COMBUSTION DEVICE

[75] Inventors: Takashi Ueki, Tokyo; Yoshihiro Ishikawa, Kagamihara, both of Japan

[73] Assignees: Rinnai Kabushiki Kaisha, Nagoya; Tokyo Gas Kabushiki Kaisha, Tokyo, both of Japan

[21] Appl. No.: 700,002

[22] Filed: Feb. 8, 1985

[51] Int. Cl.[4] ..... F24H 1/08; F23N 5/24

[52] U.S. Cl. ..... 126/351; 236/15 E; 431/76

[58] Field of Search ..... 431/76; 236/15 E; 307/130; 126/351, 117

[56] References Cited

U.S. PATENT DOCUMENTS

| | | | |
|---|---|---|---|
| 2,767,330 | 10/1956 | Marshall | 307/130 |
| 4,032,286 | 6/1977 | Kobayashi et al. | 431/76 |
| 4,125,356 | 11/1978 | Ohashi et al. | 431/76 |
| 4,392,813 | 7/1983 | Tanaka et al. | 431/76 |
| 4,396,370 | 8/1983 | Yamana et al. | 431/80 |
| 4,406,613 | 9/1983 | Naito et al. | 431/76 |

FOREIGN PATENT DOCUMENTS

| | | | |
|---|---|---|---|
| 85224 | 8/1983 | European Pat. Off. | 431/76 |
| 54-139128 | 10/1979 | Japan | 431/76 |
| 55-68528 | 5/1980 | Japan | 431/76 |
| 55-99523 | 7/1980 | Japan | 431/76 |

*Primary Examiner*—Samuel Scott
*Assistant Examiner*—Allen J. Flanigan
*Attorney, Agent, or Firm*—Leonard Bloom

[57] ABSTRACT

A CO sensor is mounted on the heat exchanger of a gas water heater (or other combustion unit) and is connected in circuit with a detecting unit mounted separately from the heater. The detecting unit generates a control voltage in opposition to a reference voltage on a solenoid. The solenoid controls a valve in a fuel supply passage to a burner (or burners) in the heater, thereby shutting off the burners when the CO concentration reaches a predetermined value. A timing circuit may be added to cut off the burners whenever a lesser CO concentration continues for a predetermined time period.

13 Claims, 11 Drawing Figures

SAFETY APPARATUS FOR COMBUSTION DEVICE

FIELD OF THE INVENTION

The present invention relates to a safety apparatus for turning off a combustion device in the event of a potentially hazardous situation, and more particularly, to a gas water heater having an externally-mounted carbon monoxide (CO) sensor for turning off the burner at predetermined concentration of CO resulting from an unusual operation of the heater.

BACKGROUND OF THE INVENTION

CO sensors or like sensing devices have been incorporated in known combustion units to turn off a.burner in the event of a potentially hazardous CO level, or in the event of a natural disaster, such as an earthquake, or an accident other than a flame failure.

However, a need exists for adapting existing combustion units on a retrofit or other basis, quickly and economically, to provide an accident detecting feature.

SUMMARY OF THE INVENTION

Accordingly, it is an object of the present invention to provide existing combustion units with an accident detecting feature, thereby shutting off the burner in the event of a potentially hazardous situation, and wherein a sensor means is provided which is separate from the main body of the combustion unit.

It is another object of the present invention to provide an accident detecting and preventing feature for a gas water heater, wherein the burner will be turned off at a predetermined CO concentration.

It is yet another object to provide a detecting unit separate from the heater and having respective conductors connected to a pair of external terminals on the heater, thereby feeding a control voltage of opposite polarity to the reference voltage to an operating solenoid.

It is a further object to provide a detecting unit having a CO sensor which is separate from the main body of the heater and is mounted externally thereon and above the heat exchanger therein.

It is a still further object to provide an accident detecting and preventing feature including a CO sensor which is economical to manufacture, easily installed, and reliable in its operation.

In accordance with the teachings of the present invention, a preferred embodiment thereof is herein disclosed in the environment of a combustion unit. The combustion unit has at least one burner therein, a safety valve in a fuel supply passage to the burner, a solenoid means for controlling the valve, and means for providing a reference voltage to the solenoid means. The improvement of the present invention includes a detecting means having a sensor means disposed separately from the combustion unit. In the event of a potentially hazardous situation, the detecting means generates a voltage of opposite polarity to the reference voltage. At a predetermined difference between the reference voltage and the generated voltage from the detecting means, the solenoid means is actuated to close the valve in the fuel supply passage, thereby turning off the burner.

In accordance with the further teachings of the present invention, the combustion unit comprises a gas water heater having a pair of burners, a heat exchanger, and a substantially tubular body therein. The means for providing a reference voltage includes a thermocouple mounted in the combustion unit in juxtapostion to the burner. The sensor means is mounted externally on the heater above the heat exchanger and comprises a CO sensor whose resistance changes in accordance with the gas concentration.

The gas water heater includes a main body having a pair of external terminals connected to the detecting means, and the generated voltage from the detecting means is connected to these external terminals in opposite polarity to the reference voltage.

The detecting means includes a power source and further includes a switching means, the sensor being connected between the power source and the switching means.

In one embodiment, the switching means includes a transistor including a base and an emitter, and the sensor is connected in the base-emitter circuit via a voltage divider.

In another embodiment, the switching means includes an AND circuit; a bridge circuit having a plurality of legs is connected between the power source and the AND circuit; and the sensor constitutes one of the legs of the bridge circuit.

In yet another embodiment, the switching means includes a thyristor having a gate; and a divider circuit is connected to the gate, the divider circuit including the sensor and a variable resistor.

The gate of the thyristor may be connected between the divider circuit and a condenser of a timing circuit. When the charge on the condenser reaches a predetermined value, the thyristor is switched ON. With this arrangement, the burner will be turned OFF whenever the CO concentration reaches a predetermined level or whenever a certain CO concentration has continued for a predetermined time period.

In accordance with the further teachings of the present invention, there is disclosed a combustion unit having at least one burner and further having a fuel supply passage means to the burner. A valve is disposed in the fuel supply passage means, and means are provided means for controlling the valve. A detecting means including CO sensing means is responsive to both a predetermined CO concentration, as well as a predetermined time interval of CO concentration, to actuate the valve controlling means, thereby closing the valve and turning off the burner.

These and other objects of the present invention will become apparent from a reading of the following specification, taken in conjunction with the enclosed drawings.

GENERAL DESCRIPTION OF THE PREFERRED EMBODIMENT

Figure 1:
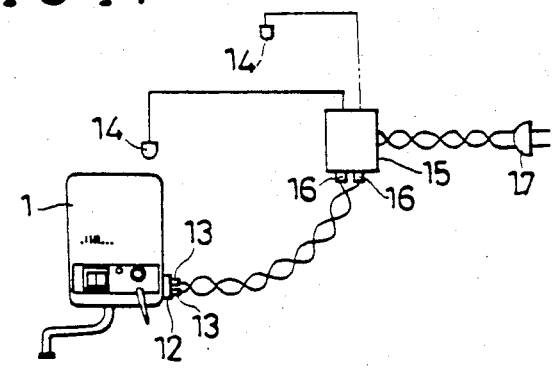
FIG. 1 is a schematic diagram of a preferred embodiment of the present invention, as applied to a gas water heater.
Figure 5:
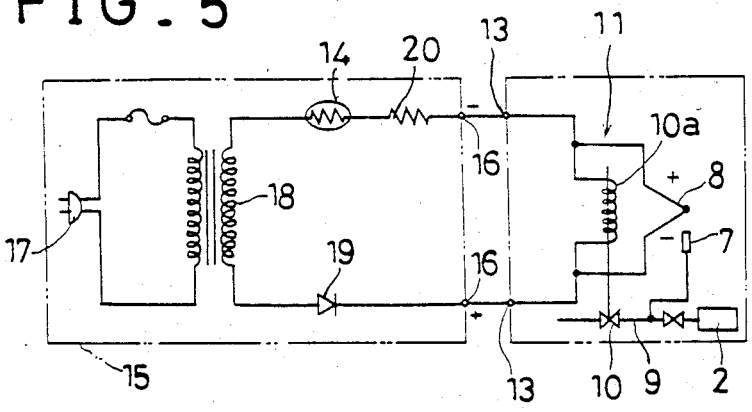
FIG. 5 is a schematic circuit diagram thereof, showing a solenoid energized to close a normally-open valve in a fuel supply passage to the burners in the water heater.
Figure 2:
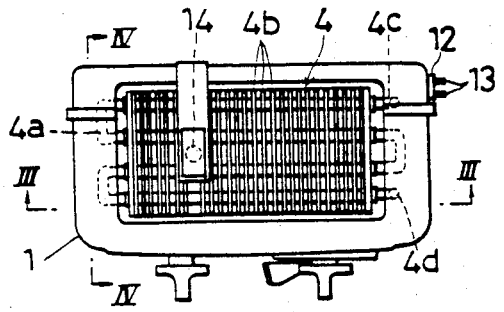
FIG. 2 is a top plan view of the gas water heater of FIG. 1.
Figure 3:
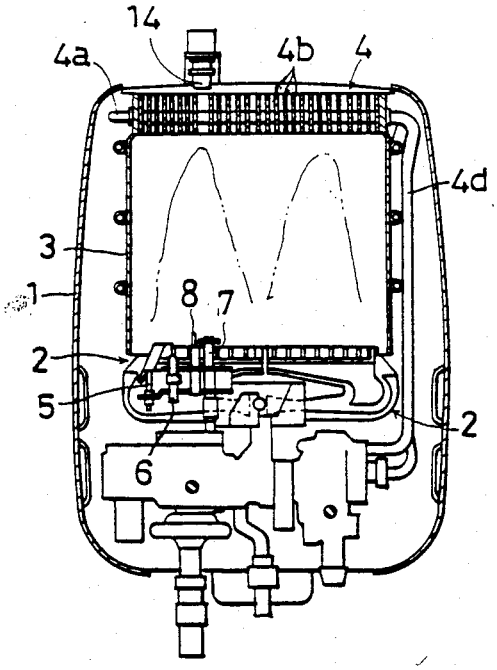
FIG. 3 is a sectional view, taken along the lines III—III of FIG. 2.
Figure 4:
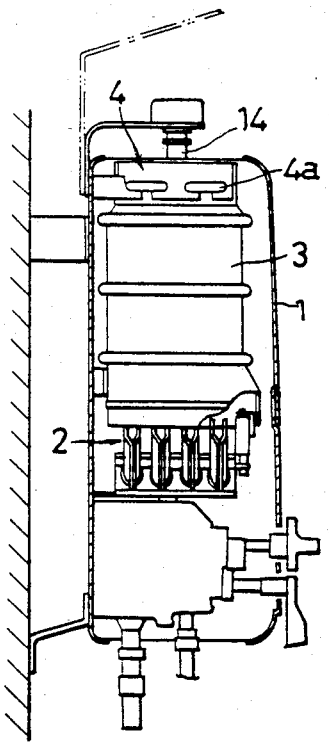
FIG. 4 is a further sectional view, taken along the lines IV—IV of FIG. 2.

With reference to FIGS. 1–5, the combustion unit constitutes a gas water heater having a main body 1 and further having at least one (and preferably two) burners 2. The burners are disposed below a tubular barrel body 3, and a heat exchanger 4 is disposed above the body. The construction of the heat exchanger 4 includes a large number of fins 4*b* attached to a zig-zag formed water pipe 4*a*, as shown more clearly in FIG. 2, thereby leaving gaps therebetween in the width direction of the heat exchanger 4. A water supply pipe 4*c* and a hot water delivery pipe 4*d* are connected to the respective end portions of the zig-zag water pipe 4*a*, and are positioned on one lateral side of the heat exchanger 4 to the front and rear thereof. Preferably, the pair of burners are located on the left and right sides of the heater, as shown more clearly in FIG. 3. An ignition burner 5, an ignition electrode 6, and a standing burner 7 are provided near the left burner 2 (as shown in FIG. 3) and the standing burner 7 heats a thermocouple 8 as shown more clearly in FIG. 5. The thermocouple 8 provides a reference voltage for an operating solenoid 10*a* which controls a safety valve 10 disposed within a fuel supply passage 9 for the burners. The arrangement constitutes a flame failure safety circuit 11. In the event of a flame failure, the solenoid 10*a* will be de-energized (or otherwise actuated) to close the normally-open valve 10, thereby turning off the burners 2. In lieu of the thermocouple, the flame detecting element may constitute a flame rod.

The structure described thus far, which is similar to that of a conventional water heater, has a normal mode of operation in which a relatively large space exists between the top of the flame on the burner 2 and the lower surface of the heat exchanger 4. However, under certain circumstances occurring during abnormal combustion, the flame may become elongated as shown by the broken lines in FIG. 3, and the outer or upper part of the flame may be brought into contact with the fins 4*b* on the heat exchanger 4 to increase the CO concentration. This condition may occur, for example, if the fuel supply to the burner 2 becomes excessive, or if the burner receives an insufficient supply of primary air because of a clogging of a primary air opening, or in the event of an insufficient supply of secondary air into the barrel body 3 because the gaps between the fins 4*b* have become clogged with foreign matter. In the event such an abnormal combustion condition is encountered, the burners 2 should be turned off promptly.

Accordingly, and consonant with the teachings of the present invention, the outer surface of the main body 1 of the heater is provided with a terminal plate 12 having a pair of external connecting terminals 13, 13, as shown more clearly in FIG. 1. These two terminals 13, 13 are connected within the heater to the respective ends of the operation solenoid 10*a*, as shown more clearly in FIG. 5, and to an external accident detecting unit 15. The detecting unit 15 includes a CO sensor 14 or other sensing means, and may be installed at any convenient location separately from the main body 1. When the CO concentration is increased at that location, an electric voltage is generated at a pair of output terminals 16, 16 on the detecting unit 15. These terminals 16, 16 on the detecting unit 15 are connected to the respective pair of external terminals 13, 13 on the heater main body 1 in a mutually opposite polarity relationship.

The detecting unit 15 includes a transformer 18 connected through a plug 17 to an outlet of an a.c. power source (not shown) and further includes a rectifying diode 19. The CO sensor 14 and a variable resistance 20 (for level adjusting) are connected between the secondary side of the transformer 18 and the pair of output terminal 16, 16. In the preferred embodiment, the CO sensor 14 comprises a semi-conductor of the $SnO_2$ series (or its equivalent) and exhibits a resistance change in the presence of CO. Ordinarily, the resistance value of the CO sensor 14 is in the range of 10–100K ohms but decreases as the CO concentration is increased. Thus, the electric voltage Vc (shown in FIG. 6) which is applied across the pair of output terminals 16, 16, increases as the CO concentration increases.

The pair of output terminals 16, 16 are detachably connected to the respective pair of external connecting terminals 13, 13 in a mutually opposite polarity relationship, such that the voltage Vc applied across the pair of output terminals 16, 16 negates the thermo-electromotive force (or reference voltage) Vt generated across the pair of external connecting terminals 13, 13, that is, across both ends of the operation solenoid 10*a*.

Figure 6:
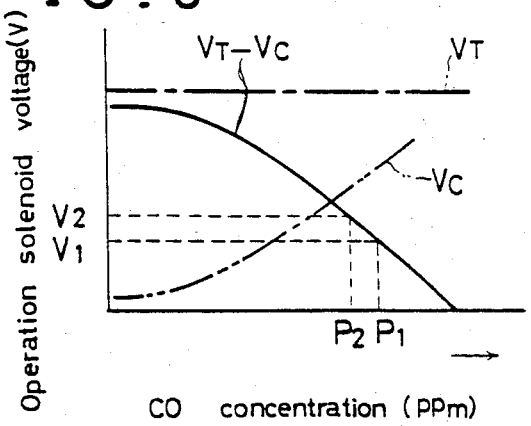
FIG. 6 is a curve of the solenoid operating voltage versus the CO concentration, showing the required voltage ($V_T - V_C$) for energizing the solenoid.

In operation, and as shown more clearly in FIG. 6, the voltage applied to the operation solenoid 10*a* is the resultant voltage of Vt−Vc. This resultant voltage decreases as Vc increases according to an increase in the CO concentration. When the CO concentration increases to a predetermined value $P_1$, the resultant voltage Vt−Vc falls below a release voltage $V_1$; and the solenoid 10*a* is released (or actuated) to close the electro-magnetic safety valve 10 for cutting off the fuel supply to the burner 2 for stopping the combustion.

The CO sensor 14 may be located at any desired position in a room that is influenced by an exhaust gas from the water heater (as shown by broken lines in FIG. 1). Preferably, however, in order to obtain a better response, the CO sensor 14 is located just above the heat exchanger 4 (as shown clearly in FIGS. 2–4). This location has the further advantage that, even when a backfire occurs at the burner 2, the CO gas produced at the time of this backfire can be detected by the sensor 14 to stop the combustion.

If the pair of burners 2 are provided on the right and the left sides of the water heater, then the CO sensor 14 is located preferably in the middle of the heat exchanger 4 and above the central portion of the left side burner 2

(as shown in FIG. 2) opposite to the location of the water supply pipe 4c.

The temperature of the heat exchanger 4 may be relatively low near the location of water supply pipe 4c. Consequently, at that portion of the heat exchanger 4, the fins 4b may be made larger in view of possible clogging in the gaps therebetween with sulfide or soot. In addition, a front portion and a rear portion of the heat exchanger 4 may be affected by an external air flowing through the upper portion of the heat exchanger 4. Accordingly, these portions should be avoided in locating the CO sensor 14. Preferably, at least one of the fins 4b located below and opposite to the CO sensor 14 is omitted, so that any clogging of the space at the portion of the heat exchanger 4 can be minimized or prevented altogether. This will assure that the exhaust gas will be brought into contact with the CO sensor 14.

As previously described, the voltage Vc corresponding to the resistance value of the CO sensor 14 is always applied across the pair of output terminals 16, 16 of the detecting unit 15. This may be inconvenient, however, in that even if the CO concentration is at a value $P_2$ which is lower than the predetermined value $P_1$ (as shown in FIG. 6) the operation solenoid 10a is applied with a resultant voltage $V_2$ near the release voltage $V_1$. At that time, if the water heater experiences a mechanical vibration during a change-over operation, such as changing the combustion amount, or for any other cause, the electromagnetic safety valve 10 may be closed, thereby inadvertently and unnecessarily stopping the combustion.

Accordingly, for improved reliability, it is desirable to stop the combustion only when the CO concentration is increased above the predetermined value $P_1$. This desirable objective is accomplished by the embodiments shown in FIGS. 7–9.

Figure 7:
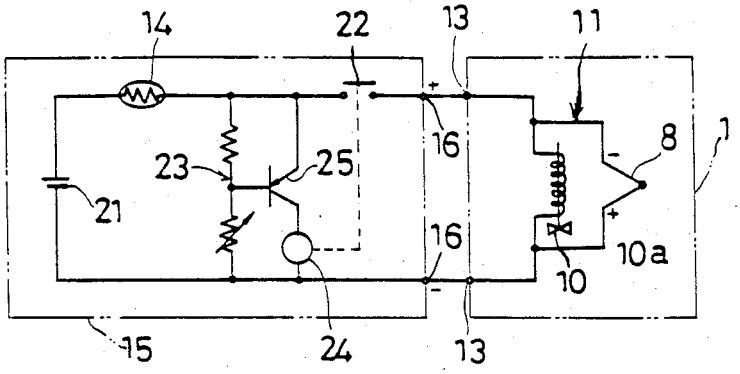
FIG. 7 is a schematic circuit diagram, corresponding substantially to FIG. 5, but showing a second embodiment having a switching transistor in the detecting unit.

With reference to FIG. 7, the accident detecting unit 15 is provided with a switching means which is turned ON only when the resistance value of the CO sensor 14 reaches the desired predetermined value. This switching means includes a switch (or other element) 22 interposed between the pair of output terminals 16, 16 and a battery 21 or other power source. A divider circuit 23 is connected through the CO sensor 14 to the battery 21, and a driving circuit for a relay 24 is disposed in parallel with the divider circuit 23. This driving circuit includes a transistor 25 connected at its base terminal to the divider point of the divider circuit 23. The switch 22 comprises a normally-open relay contact of the relay 24 connected between the power source 21 and the contacts 16, 16. If the CO concentration is increased, the resistance value of the CO sensor 14 is decreased; the voltage applied to the divider circuit 23 is increased; and a voltage across the emitter terminal and the base terminal of the transistor 25 is increased. When the CO concentration is increased to reach the predetermined value, such that the resistance value of the CO sensor 14 is lowered to the predetermined value, the transistor 25 becomes conductive (turned ON) and the relay 24 is energized to close the switch 22, such that the voltage applied across the output terminals 16, 16 closes the electromagnetic safety valve 10.

Figure 8:
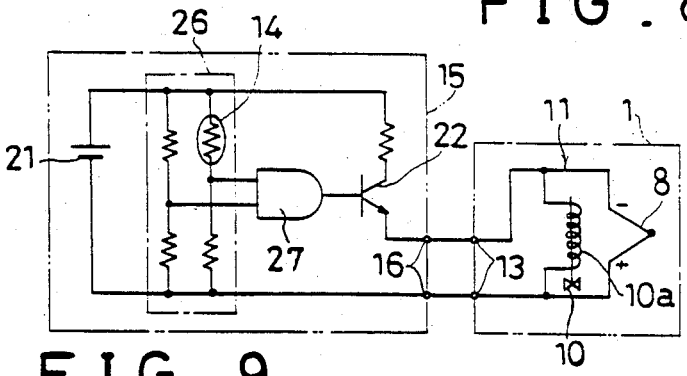
FIG. 8 is a schematic circuit diagram of a third embodiment having an AND circuit and further having the CO sensor in one of the legs of a bridge circuit between the power source and the AND circuit.

With reference to FIG. 8, a bridge circuit 26 has the CO sensor 14 incorporated therein. The input of the bridge circuit is connected to the power source 21, and the output of the bridge circuit is connected to an AND circuit 27 serving as a comparator. An input terminal on one side of the AND circuit 27 receives a detecting voltage from the bridge circuit 26 which is varied in accordance with the resistance value change of the CO sensor 14. Another input terminal on the other side of the AND circuit 27 receives a detecting voltage from the bridge circuit 26 which is varied in accordance with the resistance value change of the CO sensor 14. Another input terminal on the other side of the AND circuit 27 receives a comparison voltage which is equal to the detecting voltage obtained at the time when the resistance value of the CO sensor 14 reaches the predetermined value. If the resistance value of the CO sensor 14 is increased to reach the predetermined value, a high level output from the AND circuit 27 may be obtained. The output of the AND circuit is connected to the base of the transistor 22, which is turned ON to provide the voltage at terminals 16, 16.

Figure 9:
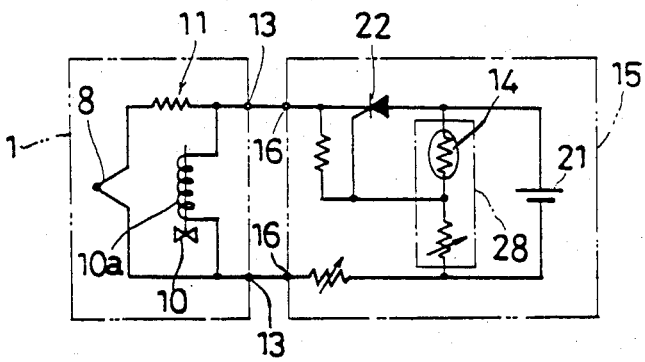
FIG. 9 is a schematic circuit diagram of a fourth embodiment having a thyristor, the gate of which is connected between the CO sensor and a variable resistor forming a divider circuit.

With reference to FIG. 9, a thyristor is used as the switching element 22, and the gate terminal of the thyristor is connected to the divider point of a divider circuit 28 having the CO sensor 14 incorporated therein. An increase in the gate voltage, caused by a decrease in the resistance value of the CO sensor 14, will turn the thyristor ON at the predetermined resistance value.

With the previously described embodiments of the present invention, the electromagnetic safety valve 10 is closed by the decrease in the resistance value of the CO sensor 14 to a predetermined value, that is, by a corresponding increase of the CO concentration to a predetermined value. With these embodiments, the electromagnetic safety valve 10 will not close if the CO concentration is below the predetermined value. From a safety standpoint, it is desirable on some occasions to set the predetermined value at a comparative low value (about 300 ppm, for instance). However, if the predetermined value is set at such a relatively low value, occasions may arise when the electomagnetic safety valve 10 will be closed unnecessarily, as for example, if a CO concentration of above 300 ppm is generated momentarily at the time of ignition of the burner 2 (or the like). This may become inconvenient.

To remove this possible inconvenience, the opening and closing control of the electromagnetic safety valve 10 may be made dependent not only on the change of the predetermined CO concentration, but also on the length of the continued time of the predetermined CO concentration. A circuit embodying this further improvement is shown in FIG. 10.

Figure 10:
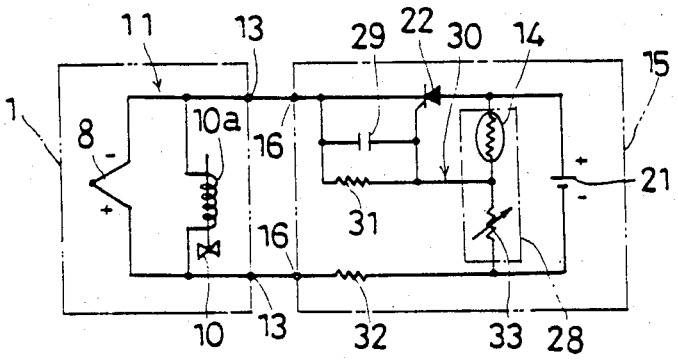
FIG. 10 is schematic circuit diagram of a fifth embodiment having a timing circuit including a condenser connected to the divider circuit and to the gate of the thyristor.

With reference to FIG. 10, a CR timer 30 (comprising the CO sensor 14 and a condenser 29) is incorporated in the detecting unit 15, and the switching element (in this example, thyristor 22) is turned ON when the charge on the condenser 29 reaches a predetermined value. More specifically, the circuit arrangement is substantially equal to that in FIG. 9, and includes the condenser 29 connected between the gate terminal and a cathode terminal of the thyristor 22.

With this arrangement, the charge on the condenser 29 is increased as the resistance value of the CO sensor 14 is decreased, thereby shortening the time T of the timer required until the charge on the condenser 29 reaches the predetermined value to turn the switching element 22 ON, in other words, the time required until the electromagnetic safety valve 10 will be closed.

If the power source 21 is a dry battery of 1.5 V, the resistance 31 interposed between a gate terminal and a cathode terminal of the switching element 22 is 3.5 ohm; the resistance 32 incorporated in the power source connecting circuit is 3.5 ohm; and the resistance value of a divider resistance 33 connected in series with the CO sensor 14 is 380 ohm.

Figure 11:
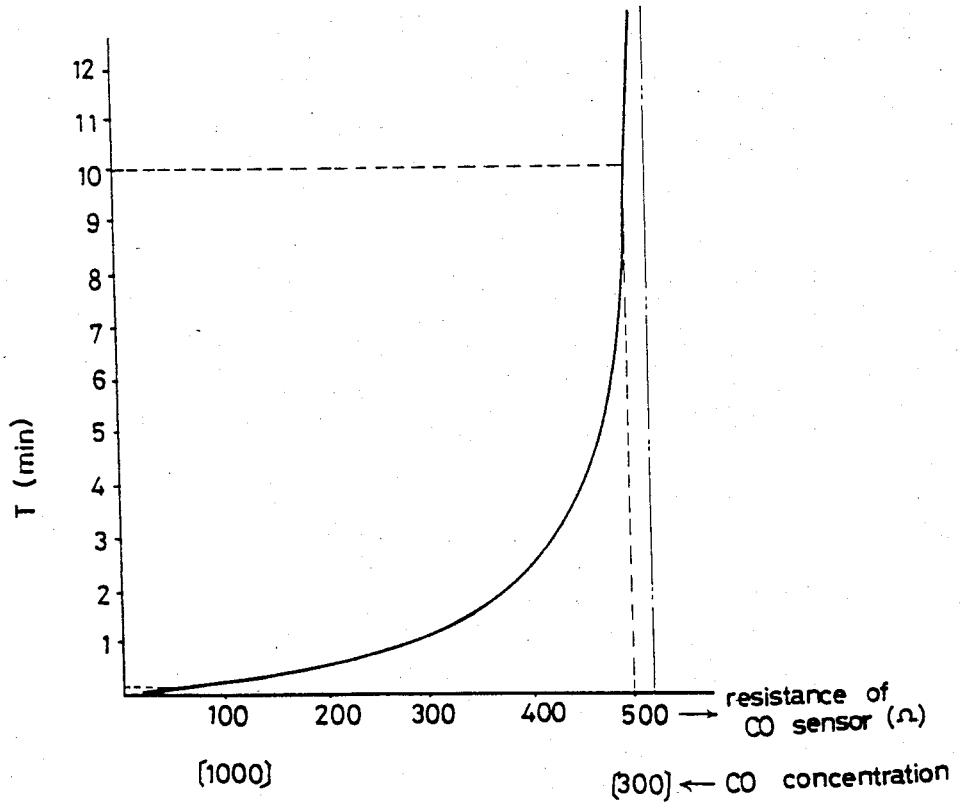
FIG. 11 is a curve illustrating the operation of the circuit shown in FIG. 10.

With reference to FIG. 11, the time T is changed in accordance with a change of the resistance value of the CO sensor 14, and thus in accordance with a change of the CO concentration. The electromagnetic safety valve 10 is closed to stop the combustion when the CO concentration reaches about 300 ppm and is continued for about 10 minutes; but if the CO concentration reaches above 1000 ppm, the combustion is stopped in the order of about one second (or less).

The CO sensor used in detecting element 15 (in the foregoing embodiments) may be replaced by a gas sensor of other kinds. Additionally, the detecting unit 15 may be replaced by one sensitive to an earthquake by incorporating therein a vibration sensitive switch, so that if an earthquake occurs, the switch may be closed to apply the voltage across the pair of output terminals.

Thus, according to the present invention, any conventional combustion device with a flame failure safety circuit may be employed as is, and an accident detecting unit may be prepared separately from the combustion device and assembled thereto so as to form a safety apparatus for the combustion device. The safety apparatus can be produced at a comparatively low cost, as a retrofit to existing combustion devices, without the necessity to purchase a new combustion device having a disorder detecting feature.

Obviously, many modifications may be made without departing from the basic spirit of the present invention. Accordingly, within the scope of the appended claims, the invention may be practiced other than specifically disclosed herein.

What is claimed is:

1. In a combustion unit having at least one burner therein, a safety valve in a fuel supply passage to the burner, a solenoid means for controlling the valve, and means for providing a reference voltage to the solenoid means, the improvement which comprises a detecting means including a sensor means operatively positioned and arranged with respect to the combustion unit for sensing concentration of CO in space influenced by exhaust gas therefrom, said detecting means also including a power source and a switching means, the sensor means being connected between the power source and the switching means; and wherein in the event of a potentially hazardous situation, the detecting means generates a voltage of opposite polarity to the reference voltage, and wherein at a predetermined difference between the reference voltage and the generated voltage from the detecting means, the solenoid means is actuated to close the valve in the fuel supply passage, thereby turning off the burner.

2. The improvement of claim 1, wherein the switching means includes a transistor including a base and an emitter, and wherein the sensor means is connected in the base-emitter circuit via a voltage divider.

3. The improvement of claim 1, wherein the switching means includes an AND circuit, wherein a bridge circuit having a plurality of legs is connected between the power source and the AND circuit, and wherein the sensor means constitutes one of the legs of the bridge circuit.

4. The improvement of claim 1, wherein the switching means includes a thyristor having a gate, and wherein a divider circuit is connected to the gate, the divider circuit comprising a variable resistor and the sensor means.

5. The improvement of claim 4, further including a timing circuit having a condenser, wherein the gate of the thyristor is connected between the condenser and the divider circuit, whereby when the charge in the condenser reaches a predetermined value, the thyristor is switched ON.

6. In a gas water heater, the combination of at least one burner, a heat exchanger, a body between the burner and the heat exchanger, a safety valve in a fuel supply passage to the burner, a solenoid means for controlling the valve, means including a thermocouple mounted in the heater in juxtaposition to the burner for providing a reference voltage, a pair of external terminals on the heater, a detecting unit connected to the terminals and generating a voltage of opposite polarity to the reference voltage, the detecting unit including a power source, a switching element and a sensor means connected therebetween, and the sensor means comprising a CO sensor whose resistance changes in accordance with the gas concentration, whereby at a predetermined difference between the reference voltage and the voltage generated by the detecting unit, the solenoid means is actuated to close the valve, thereby turning off the burner.

7. The combination of claim 6, wherein the CO sensor is mounted on the heater above the heat exchanger.

8. The improvement of claim 6, wherein the switching means includes a transistor including a base and an emitter, and wherein the CO sensor is connected in the base-emitter circuit via a voltage divider.

9. The improvement of claim 6, wherein the switching means includes an AND circuit, wherein a bridge circuit having a plurality of legs is connected between the power source and the AND circuit, and wherein the CO sensor constitutes one of the legs of the bridge circuit.

10. The improvement of claim 6, wherein the switching means includes a thyristor having a gate, and wherein a divider circuit is connected to the gate, the divider circuit comprising a variable resistor and the CO sensor.

11. The improvement of claim 10, further including a timing circuit having a condenser, wherein the gate of the thyristor is connected between the condenser and the divider circuit, whereby when the charge on the condenser reaches a predetermined value, the thyristor is switched ON.

12. In a combustion unit, the combination of at least one burner, a fuel supply passage means to the burner, a valve in the fuel supply passage means, means for controlling the valve, and detecting means including CO sensing means responsive to both a predetermined CO concentration and to a predetermined time period of a CO concentration to actuate the valve controlling means, thereby closing the valve and turning off the burner, wherein the detecting means also includes a power source and a switching element, and wherein the sensing means is connected between the power source and the switching element.

13. The combination of claim 12, wherein the combustion unit includes a heat exchanger, and wherein the CO sensing means comprises a CO sensor mounted on the combustion unit above the heat exchanger.

* * * * *